US008052253B2

(12) United States Patent
Wee et al.

(10) Patent No.: US 8,052,253 B2
(45) Date of Patent: Nov. 8, 2011

(54) INKJET HEAD HAVING PIEZOELECTRIC ACTUATOR FOR RESTRICTOR, AND IMAGE FORMING METHOD AND APPARATUS HAVING THE SAME

(75) Inventors: Sang-kwon Wee, Hwaseong-si (KR); Se-young Oh, Yongin-si (KR); Jae-woo Chung, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 751 days.

(21) Appl. No.: 11/758,270

(22) Filed: Jun. 5, 2007

(65) Prior Publication Data

US 2008/0018715 A1 Jan. 24, 2008

(30) Foreign Application Priority Data

Jul. 19, 2006 (KR) ..... 10-2006-0067303

(51) Int. Cl.
*B41J 2/045* (2006.01)

(52) U.S. Cl. ..... 347/70

(58) Field of Classification Search ..... 347/70, 347/68–69, 71–72; 400/124.14–124.17, 400/124.23; 310/323.06, 323.08, 324, 330, 310/331

See application file for complete search history.

(56) References Cited

U.S. PATENT DOCUMENTS

| | | | | |
|---|---|---|---|---|
| 7,364,275 | B2 * | 4/2008 | Lim et al. | 347/70 |
| 2007/0195134 | A1 * | 8/2007 | Lee et al. | 347/72 |
| 2007/0216735 | A1 * | 9/2007 | Kobayashi et al. | 347/68 |
| 2008/0084458 | A1 * | 4/2008 | Sugahara | 347/70 |

* cited by examiner

*Primary Examiner* — K. Feggins
(74) *Attorney, Agent, or Firm* — Stanzione & Kim, LLP

(57) ABSTRACT

A piezoelectric inkjet head having piezoelectric actuators for restrictors includes a flow channel plate including an ink inlet through which ink enters, a plurality of pressure chambers into which ink to be ejected is filled, a manifold which is a path to receive ink from the ink inlet and to supply the received ink to the pressure chambers, a plurality of restrictors that connect the manifold to the pressure chambers, and a plurality of nozzles to eject ink from the pressure chambers to an outside thereof. The piezoelectric inkjet head also includes a plurality of first piezoelectric actuators formed on the flow channel plate corresponding to positions of the pressure chambers to provide a driving force to each of the pressure chambers to eject ink to the outside. The piezoelectric inkjet head also includes a plurality of second piezoelectric actuators formed on the flow channel plate corresponding to positions of the restrictors to change cross-sectional areas of the restrictors.

24 Claims, 6 Drawing Sheets

INKJET HEAD HAVING PIEZOELECTRIC ACTUATOR FOR RESTRICTOR, AND IMAGE FORMING METHOD AND APPARATUS HAVING THE SAME

CROSS-REFERENCE TO RELATED APPLICATIONS

This application claims the benefit of Korean Patent Application No. 10-2006-0067303, filed on Jul. 19, 2006, in the Korean Intellectual Property Office, the disclosure of which is incorporated herein in its entirety by reference.

BACKGROUND OF THE INVENTION

1. Field of the Invention

The present general inventive concept relates to a piezoelectric inkjet head, and more particularly, to an inkjet head having piezoelectric actuators to change cross-sectional areas of restrictors, and an image forming method and apparatus having the same.

2. Description of the Related Art

An inkjet head is a device for printing a predetermined color image by ejecting minute droplets of ink on desired areas of a printing medium. Inkjet heads can be generally classified into two types according to the ejection mechanism of ink droplets. The first type is a thermal inkjet head that ejects ink droplets using the expansion force of ink bubbles created using a heat source, and the second type is a piezoelectric inkjet head that ejects inkjet droplets using a pressure created by the deformation of a piezoelectric element.

FIGS. 1 and 2 are respectively a plan view and a cross-sectional view of a configuration of a conventional piezoelectric inkjet head.

Referring to FIGS. 1 and 2, a plurality of flow channel plates 10, 20, and 30 include an ink inlet 61, a manifold 62, a plurality of restrictors 63, a plurality of pressure chambers 64, and a plurality of nozzles 65, which constitute an ink flow channel. A plurality of piezoelectric actuators 40 are formed at various positions on a first flow channel plate 10 corresponding to the pressure chambers 64. The manifold 62 is formed in a second flow channel plate 20, and performs as a common path for supplying ink to the pressure chambers 64 when the ink is supplied from an ink tank (not shown). The restrictors 63 are formed in the upper part of the second flow channel plate 20 to connect the manifold 62 to the pressure chambers 64. The pressure chambers 64 where ink to be ejected is filled are formed in the second flow channel plate 20 and arranged on one side or both sides of the manifold 62. The volume of each of the pressure chambers 64 is changed by the driving of the piezoelectric actuator 40, which causes a pressure change in the pressure chambers 64 resulting in ejecting or receiving of ink through the nozzle 65 formed on a third flow channel plate 30. For this purpose, portions of the first flow channel plate 10 that cover the pressure chambers 64 perform as vibration plates 12 that deform due to the driving of the piezoelectric actuators 40. The nozzles 65 are formed through the third flow channel plate 30 and respectively are connected to the pressure chambers 64.

An operation of the conventional piezoelectric inkjet head having the above configuration will now be described. When a driving signal is applied to the piezoelectric actuators 40, the piezoelectric actuators 40 deform together with the vibration plates 12. Thus, the volumes of the pressure chambers 64 are reduced resulting in a pressure increase in the pressure chambers 64, and thus, ink in the pressure chambers 64 is ejected to the outside through the nozzles 65. Next, when the piezoelectric actuators 40 and the vibration plates 12 are restored to the original positions, the volumes of the pressure chambers 64 are increased. Due to the reduced pressure in the pressure chambers 64, the pressure chambers 64 are refilled with ink from the manifold 62 through the restrictors 63.

However, in the conventional piezoelectric inkjet head, in the process of ejecting ink due to the driving of the piezoelectric actuators 40, the ink is ejected to the outside through the nozzles 65, and a portion of the ink backflows towards the manifold 62 through the restrictors 63.

The ink that backflows affects adjacent pressure chambers 64 through the manifold 62, that is, it causes cross-talk. The cross-talk causes unstable meniscus of ink in the nozzles 65 connected to the adjacent pressure chambers 64, and thus, causes deviations in speed and volume of ink droplets ejected through each of the nozzles 65. Also, due to the backflow of ink, the volumes of ink ejected through the nozzles 65 are reduced.

Accordingly, the restrictors 63 must function to refill ink into the pressure chambers 64 from the manifold 62 and to block the backflow of ink when ejecting the ink to the outside. In order to effectively block the backflow of ink, the restrictors 63 may have a small cross-sectional area. However, on the contrary, in order to refill ink smoothly, the restrictors 63 must have a large cross-sectional area. However, the conventional restrictors 63 have a fixed cross-sectional area, and thus, it is difficult to meet the two above conditions.

SUMMARY OF THE INVENTION

The present general inventive concept provides a piezoelectric inkjet head that can prevent backflow of ink and can ensure smooth refill ink to pressure chambers by providing piezoelectric actuators that provide a driving power to ejecting ink and change a cross-sectional area of restrictors, and an image forming method and apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a piezoelectric inkjet head including a flow channel plate having an ink inlet through which ink enters; a plurality of pressure chambers into which ink to be ejected is filled, a manifold which is a path to supply ink to enter the pressure chambers through the ink inlet, a plurality of restrictors that connect the manifold to the pressure chambers, and a plurality of nozzles to eject ink from the pressure chambers to the outside, a plurality of first piezoelectric actuators formed on the flow channel plate corresponding to the positions of the pressure chambers to provide a driving force to each of the pressure chambers to eject ink to an outside thereof, and a plurality of second piezoelectric actuators formed on the flow channel plate corresponding to the positions of the restrictors to change the cross-sectional areas of the restrictors.

When ink is ejected from the pressure chambers to the outside through the nozzles due to the driving of the first piezoelectric actuators, the cross-sectional areas of the restrictors may be reduced due to the driving of the second piezoelectric actuators to prevent the ink from flowing back from the pressure chambers to the manifold through the restrictors.

The second piezoelectric actuators may be controlled either in connection with the first piezoelectric actuators or independently from the first piezoelectric actuators.

Each of the first piezoelectric actuators and each of the second piezoelectric actuators may comprise a lower electrode formed on the flow channel plate, a piezoelectric film formed on the lower electrode, and an upper electrode formed on the piezoelectric film.

The lower electrodes of the first piezoelectric actuators and the lower electrodes of the second piezoelectric actuators may be formed in one conductive metal layer.

The flow channel plate may include a plurality of stacked flow channel plates.

The first piezoelectric actuators and the second piezoelectric actuators may be formed on an uppermost flow channel plate of the flow channel plates, and portions of the uppermost flow channel plate that cover the pressure chambers and portions of the uppermost flow channel plate that cover the restrictors respectively may perform as vibration plates which are deformed due to the driving of the first piezoelectric actuators and the second piezoelectric actuators.

Each of the flow channel plates may be a silicon substrate.

The foregoing and/or other aspects and utilities of the present general inventive concept may also be achieved by providing a piezoelectric inkjet head including a manifold to define a first path of ink, an ink chamber to define a second path of ink, a restrictor disposed between the manifold and the restrictor to define a third path between the first path and the second path, a first actuator to control a volume of the second path of the ink chamber, and a second actuator to control a volume of the third path of the restrictor.

The first actuator may have a first dimension, and the second actuator may have a second dimension greater than the first dimension.

The first actuator may have a first length and a first width, and the second actuator may have a second length and a second width.

The first length may be longer than the second length.

The first width may be wider than the second width.

The piezoelectric inkjet head may further include a flow channel plate formed with the manifold, the ink chamber, and the restrictor, and the first actuator may be disposed on a first portion of the flow channel, and the second actuator is disposed on a second portion of the flow channel plate.

The first portion and the second portion of the flow channel plate may be spaced-apart from each other.

The first portion may be larger than the second portion in area.

The first portion generates a first deformation to the second path of the ink chamber, and the second portion generates a second deformation to the third path of the restrictor.

The piezoelectric inkjet head may further include a flow channel plate formed with the manifold, the ink chamber, and the restrictor, and the first and second actuators may be formed on the flow channel plate to correspond to the ink chamber and the restrictor, respectively.

The flow channel plate may include a first plate on which the first and second actuators are formed; a second plate having the manifold and the restrictor to define the first path and third path with the first plate, and a third plate having a nozzle plate through which the ink is ejected from the ink chamber, and to define the second path with the second plate and the first plate.

The flow channel plate may include a first plate, and a second plate formed on the first plate, and the manifold, the ink chamber, and the restrictor are formed between the first plate and the second plate to define a first path of ink, a second path of ink, and a third path of ink, respectively.

The first and second actuators may be formed on one of the first plate and the second plate.

The first actuator may change a pressure of the ink chamber, and the second actuator may reduce a backflow of the ink from being transmitted from the ink chamber to the manifold when the first actuator changes the pressure of the ink chamber.

The first and second actuators may simultaneously control volumes of the second path of the ink chamber and the volume of the third path of the restrictor.

The second actuator may change a cross-sectional area of the third path of the restrictor.

The second actuator may include a vibration plate to move between a first position and a second position to change the volume of the third path.

The second actuator may be disposed to face the restrictor through the third path.

The foregoing and/or other aspects and utilities of the present general inventive concept may be achieved by providing a piezoelectric inkjet head including a manifold to define a first path of ink, an ink chamber to define a second path of ink, a restrictor disposed between the manifold and the restrictor to define a third path between the first path and the second path, a first actuator having a first vibration plate to move between two positions to control the second path of the ink chamber to eject the ink, and a second actuator having a second vibration plate to move between two positions to control the third path of the restrictor to control a backflow of the ink between the ink chamber and the manifold.

The foregoing and/or other aspects and utilities of the present general inventive concept may be achieved by providing an image forming apparatus including a paper feeding unit to feed a printing medium, and a printing unit to print an image on the fed printing medium, the printing unit including a manifold to define a first path of ink, an ink chamber to define a second path of ink, a restrictor disposed between the manifold and the restrictor to define a third path between the first path and the second path, a first actuator to control a volume of the second path of the ink chamber, and a second actuator to control a volume of the third path of the restrictor.

The foregoing and/or other aspects and utilities of the present general inventive concept may be achieved by providing a method of an image forming apparatus, the method including providing a print unit having a manifold to define a first path of ink, an ink chamber to define a second path of ink, a restrictor disposed between the manifold and the restrictor to define a third path between the first path and the second path, a first actuator to control a volume of the second path of the ink chamber, and a second actuator to control a volume of the third path of the restrictor, and controlling the first actuator and the second actuator to eject the ink from the second path to an outside thereof from the ink chamber and to prevent influence of a backflow in the restrictor, respectively.

The foregoing and/or other aspects and utilities of the present general inventive concept may be achieved by providing a method of an image forming apparatus, the method including forming a manifold to define a first path of ink, forming an ink chamber to define a second path of ink, forming a restrictor disposed between the manifold and the restrictor to define a third path between the first path and the second path, forming a first actuator to control a volume of the second path of the ink chamber, and forming a second actuator to control a volume of the third path of the restrictor.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
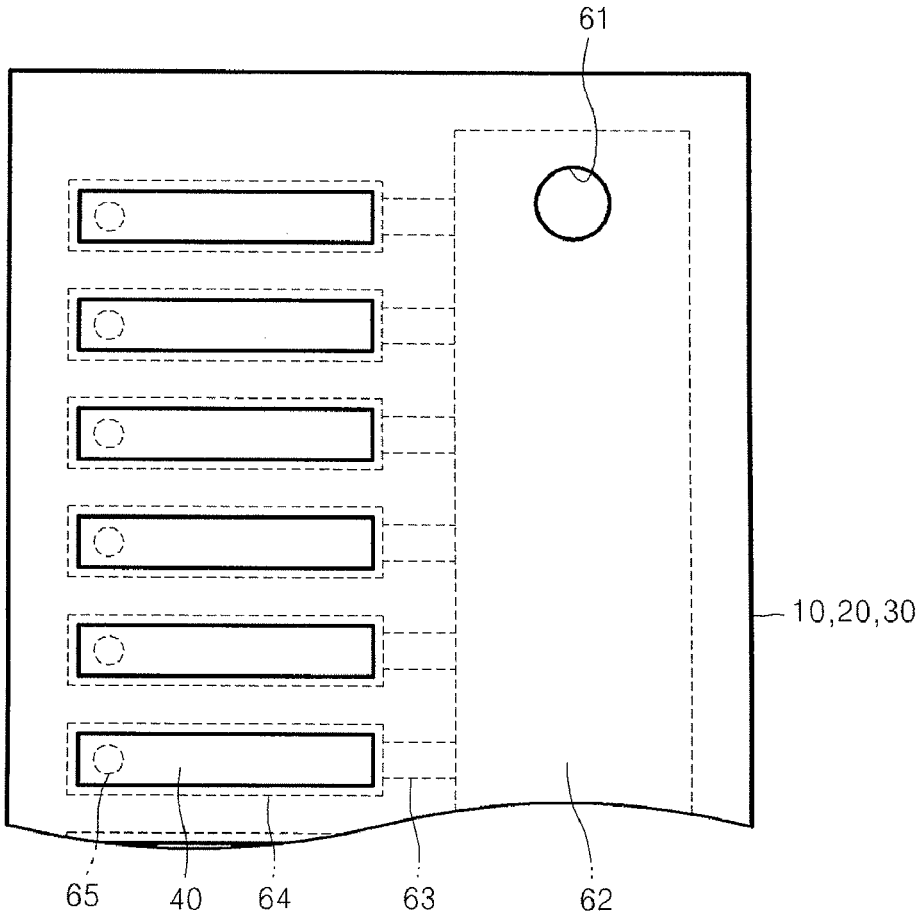
FIG. 1 (PRIOR ART)
FIG. 1 is a plan view of a conventional piezoelectric inkjet head.
Figure 2:
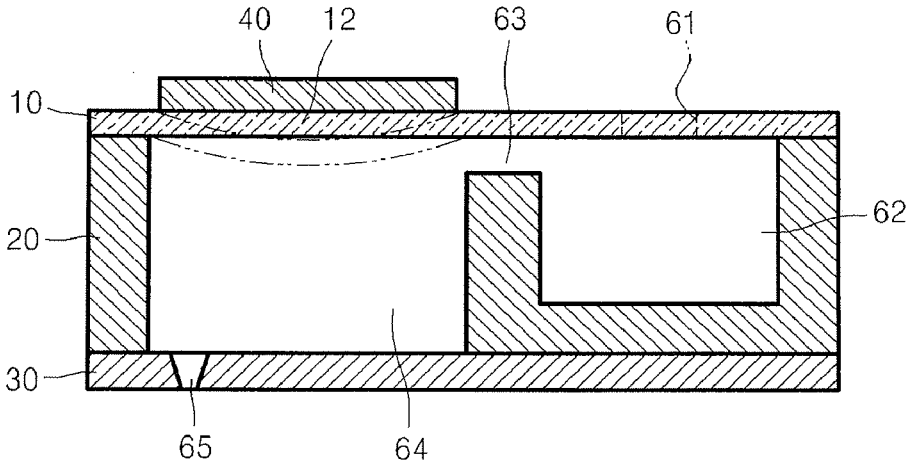
FIG. 2 (PRIOR ART)
FIG. 2 is a cross-sectional view taken in a lengthwise direction of pressure chambers of the conventional piezoelectric inkjet head of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
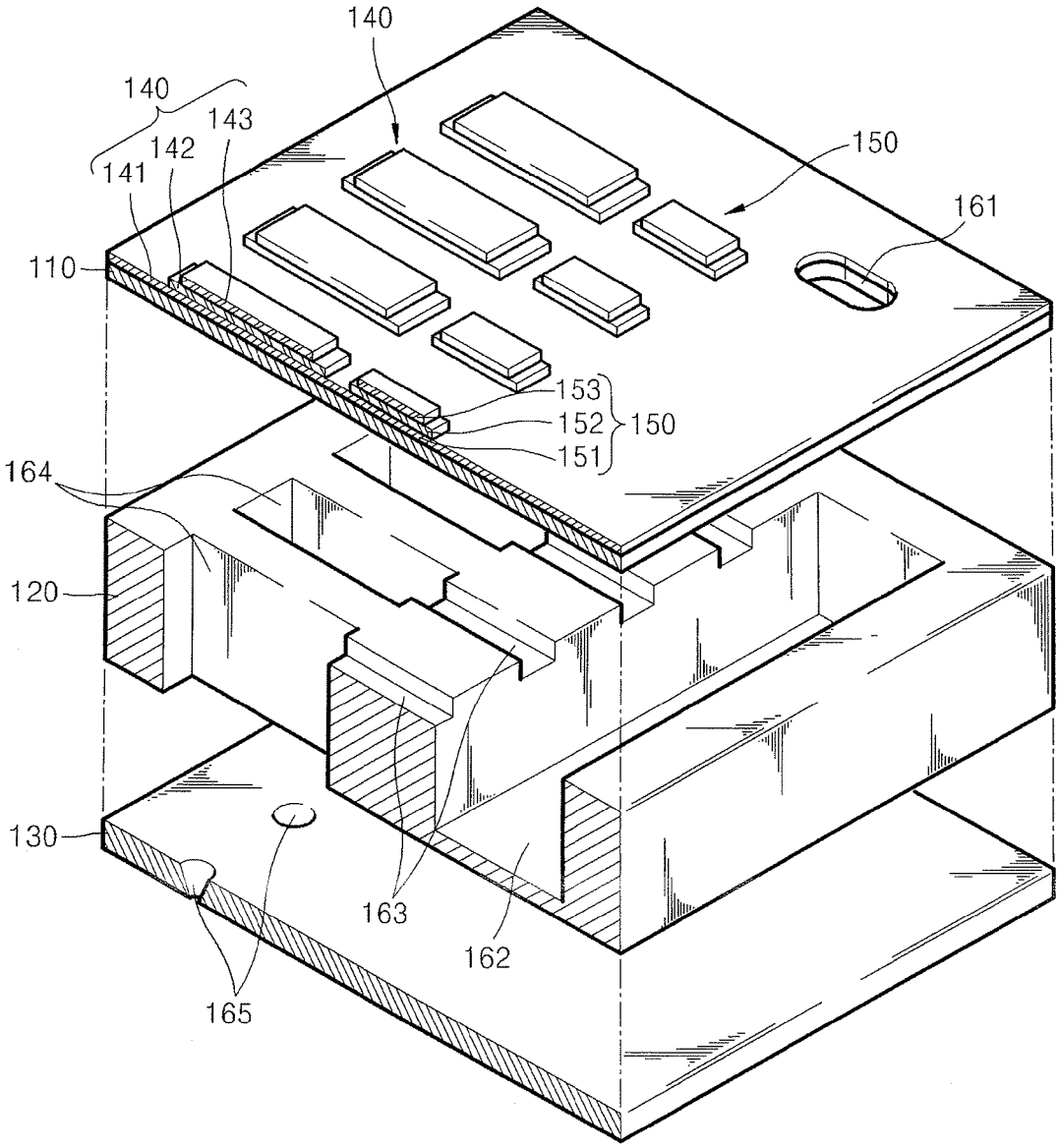
FIG. 3 is a cutaway exploded perspective view illustrating a piezoelectric inkjet head according to an embodiment of the present general inventive concept.
Figure 4:
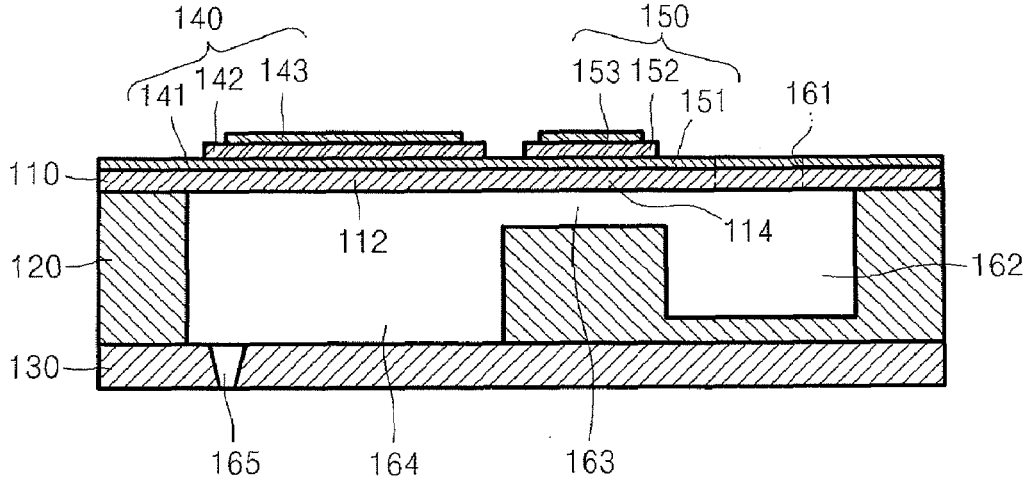
FIG. 4 is a cross-sectional view illustrating a vertical structure of the piezoelectric inkjet head of FIG. 3, according to an embodiment of the present general inventive concept.

FIG. 3 is a cutaway exploded perspective view illustrating a piezoelectric inkjet head according to an embodiment of the present general inventive concept. FIG. 4 is a cross-sectional view of a vertical structure of the piezoelectric inkjet head of FIG. 3.

Referring to FIGS. 3 and 4, the piezoelectric inkjet head according to an embodiment of the present general inventive concept includes flow channel plates 110, 120, and 130 having an ink flow channel and first and second piezoelectric actuators 140 and 150 formed thereon.

The ink flow channel formed in the flow channel plate 110, 120, and 130 includes an ink inlet 161 through which ink enters from an ink tank (not shown), a plurality of pressure chambers 164 where ink to be ejected is filled, a manifold 162 which is a path to receive ink from the ink inlet 161 to supply the received ink to the pressure chambers 164, a plurality of restrictors 163 that connect the manifold 162 to the pressure chambers 164, and a plurality of nozzles 165 to eject ink to an outside thereof from the pressure chambers 164.

The flow channel plates 110, 120, and 130 can include a first flow channel plate 110, a second flow channel plate 120, and a third flow channel plate 130, and can be a silicon substrate widely used for manufacturing semiconductor integrated circuits.

The manifold 162 having a length in a direction can be formed in the second flow channel plate 120 to communicate with the restrictors 163. The pressure chambers 164 can be formed in a row in the second flow channel plate 120 at a side of the manifold 162. The pressure chambers 164 may be arranged in the direction of the manifold 162. The restrictors 163 can be formed to a predetermined depth in the upper part of the second flow channel plate 120 to connect the manifold 162 to the pressure chambers 164.

The restrictors 163 may be disposed parallel to the pressure chambers 164 and/or the manifold 162. Each of the restrictors 163 may have a cross-sectional area parallel to the direction of the manifold 162. The pressure chambers 164 may have a different cross-sectional area from the cross-sectional area of the restrictors 163.

The first flow channel plate 110 can be stacked on the second flow channel plate 120 to cover the manifold 162 and the pressure chambers 164. The ink inlet 161 is vertically formed through the first flow channel plate 110 to be connected to the manifold 162.

The third flow channel plate 130 is located under the second flow channel plate 120 and can include the nozzles 165 that correspond to the pressure chambers 164.

The flow channel plates 110, 120, and 130 may be formed in a monolithic single body which includes the ink flow channel having the I ink inlet 161, the plurality of pressure chambers 164, the manifold 162, the plurality of restrictors 163, and the plurality of nozzles 165. The first and second piezoelectric actuators 140 and 150 may be formed thereon as the monolithic single body. It is possible that a conventional manufacturing process can be used to manufacture the monolithic single body to form the ink flow channel and the first and second piezoelectric actuators 140 and 150.

The flow channel plates 110, 120, and 130 can be formed as two substrates or four or more substrates. When the two substrates are used, a combination of two of the flow channel plates 110, 120, and 130 is formed as a single monolithic body. Thus, the flow channel plates 110, 120, and 130 illustrated in FIGS. 3 and 4 are examples. Also, the arrangement and structure of the ink flow channel formed in the flow channel plates 110, 120, and 130 are examples.

The first piezoelectric actuators 140 are formed on the flow channel plate 110 to correspond to the positions of the pressure chambers 164, and the second piezoelectric actuators 150 are formed on the flow channel plate 110 to correspond to the positions of the restrictors 163. More specifically, the first piezoelectric actuators 140 can be formed on a region of an upper surface of the first flow channel plate 110 that covers corresponding ones of the pressure chambers 164. The second piezoelectric actuators 150 can be formed on another region of the upper surface of the first flow channel plate 110 that covers corresponding ones of the restrictors 163. In this case, portions of the first flow channel plate 110 that cover corresponding ones of the pressure chambers 164 can perform as first vibration plates 112 that are deformed due to driving of corresponding ones of the first piezoelectric actuators 140. Also, other portions of the first flow channel plate 110 that cover corresponding ones of the restrictors 63 can perform as second vibration plates 114 that are deformed due to driving of corresponding ones of the second piezoelectric actuators 150.

Each of the first piezoelectric actuators 140 can include a first lower electrode 141 that performs as a common electrode, a first piezoelectric film 142 that is deformed according to a driving signal, and a first upper electrode 143 that performs as a driving electrode. The first lower electrode 141 can be formed on the entire surface of the first flow channel plate 110 and can be formed of a conductive metal layer. The first piezoelectric film 142 is formed on a corresponding portion of the first lower electrode 141, and can be formed of a piezoelectric material or a lead zirconate titanate (PZT) ceramic material. The upper electrode 143 is formed on the first piezoelectric film 142, and performs as the driving electrode that applies a voltage to the first piezoelectric film 142.

Each of the second piezoelectric actuators 150 can also include a second lower electrode 151, a second piezoelectric film 152 that deforms according to a driving signal, and a second upper electrode 153 that performs as a driving electrode. The configuration and operation of each of the second lower electrode 151, the second piezoelectric film 152 and the second upper electrode 153 may be the same as the first lower electrode 141, the first piezoelectric film 142, and the first upper electrode 143 described above, respectively.

As illustrated in FIGS. 3 and 4, the first lower electrodes 141 of the first piezoelectric actuators 140 and the second lower electrodes 151 of the second piezoelectric actuators 150 can be formed in a single monolithic conductive metal layer.

The first piezoelectric actuators 140 having the above structure provide to each of the pressure chambers 164 a driving force to eject ink, and the second piezoelectric actuators 150 change the cross-sectional area of each of the restrictors 163. The cross-section area may be defined by the restrictor 163 and a corresponding portion of an inside surface of the flow channel plate 110.

Figure 5A:
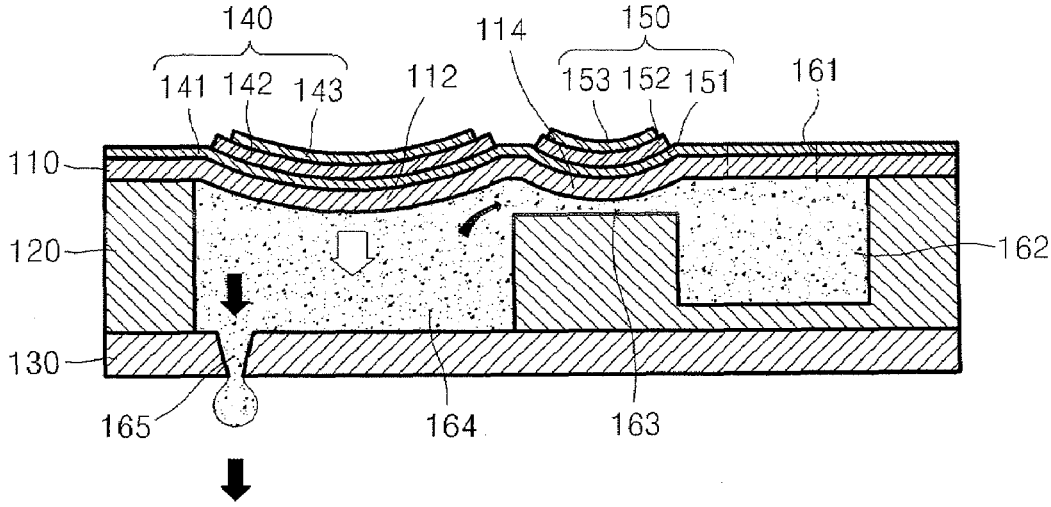
FIGS. 5A and 5B are cross-sectional views illustrating an operation of the piezoelectric inkjet head according to an embodiment of the present general inventive concept.
Figure 5B:
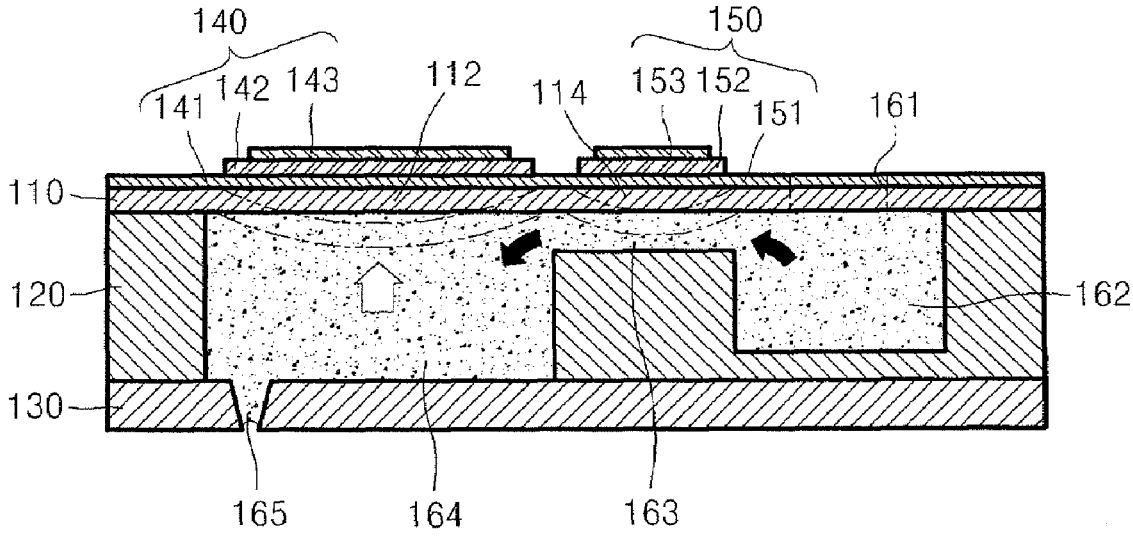

An operation of the piezoelectric inkjet head according to an embodiment of the present general inventive concept will now be described with reference to FIGS. 5A and 5B.

Referring to FIGS. 3 through 5A, when a driving signal is applied to the first piezoelectric actuators 140 to eject ink to the outside, the vibration plates 112 formed under the first piezoelectric actuators 140 are deformed according to actuation or deactivation of the first piezoelectric actuators 140. As a result, volumes of the pressure chambers 164 are reduced. The volume reduction of the pressure chambers 164 increases the pressure in the pressure chambers 164, and thus, ink in the pressure chambers 164 is ejected to the outside through the nozzles 165. A driving signal is applied to the second piezoelectric actuators 150 in connection with the driving of the first piezoelectric actuators 140 or independently of the driving of the first piezoelectric actuators 140. When a driving signal is applied to the second piezoelectric actuators 150, the cross-sectional areas of the restrictors 163 are reduced due to the deformation of the second piezoelectric actuators 150 together with the vibration plates 114 formed under the second piezoelectric actuators 150. At this point, the driving of the second piezoelectric actuators 150 can be simultaneously performed with the driving of the first piezoelectric actuators 140, or can be performed a predetermined time after the driving of the first piezoelectric actuators 140.

In this way, since the cross-sectional areas of the restrictors 163 are reduced, a backflow of ink from the pressure chambers 164 to the manifold 162 can be prevented. Accordingly, cross-talk between the pressure chambers 164, that is, interference between the adjacent nozzles 165 due to the backflow of ink can be prevented. Also, since the majority of the driving force of the first piezoelectric actuators 140 can be used to eject ink, the volumes and speed of the ink droplets ejected through the nozzles 165 can be increased.

Next, referring to FIGS. 3 through 5B, after the ejection of ink is completed, when the first piezoelectric actuators 140 and the vibration plates 112 return to the original positions, the volumes of the pressure chambers 164 are increased. As a result, the pressure in the pressure chambers 164 is reduced, and thus, ink is refilled into the pressure chambers 164 from the manifold 162. At this point, the second piezoelectric actuators 150 and the vibration plates 114 also return to the original positions. Thus, the cross-sectional areas of the restrictors 163 are increased, and thus, a sufficient amount of ink can be refilled into the pressure chambers 164.

As described above, in the piezoelectric inkjet head according to the present general inventive concept, first piezoelectric actuators that provide a driving force for ejecting ink to the outside are formed on pressure chambers, and second piezoelectric actuators that change the cross-sectional areas of restrictors are formed on the restrictors. Therefore, the backflow of ink from the pressure chambers to the manifold through the restrictors can be prevented during ejecting of the ink. As a result, cross-talk between adjacent nozzles can be prevented, and the volumes and speed of droplets ejected through the nozzles are increased. Also, a sufficient amount of ink can be refilled into the pressure chambers from the manifold.

As described above, the second piezoelectric actuators 150 may be used as a restrictor area adjusting apparatus to change or adjust a passage of the ink in the restrictor or to control an amount of the ink passing therethrough.

Figure 6:
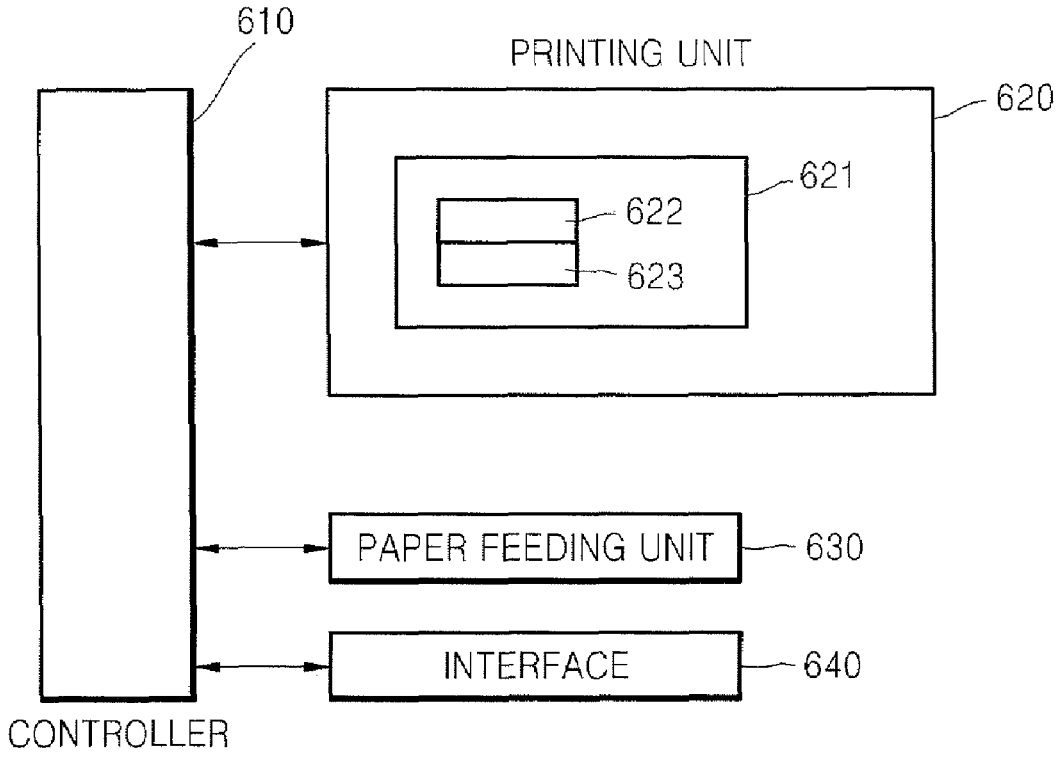
FIG. 6 is a view illustrating an image forming apparatus according to an embodiment of the present general inventive concept.

FIG. 6 is a view illustrating an image forming apparatus according to an embodiment of the present general inventive concept. Referring to FIGS. 3 and 6, the image forming apparatus may include a controller 610, a printing unit 620, a paper feeding unit 630, and an interface 640. The controller 610 controls operations of the printing unit 620, the paper feeding unit 630, the interface 640, and other components, to perform a printing operation. The printing unit 620 may include a piezoelectric inkjet head 621 which may be the same as the piezoelectric inkjet head of FIG. 3 and may include a first actuator 622 and a second actuator 623 which may be the same as the first and second piezoelectric actuators 140 and 150, respectively. The paper feeding unit 630 may include a cassette to store one or more printing medium and rollers to picks up and feeds the printing mediums one by one to the printing unit 620, and the interface unit 640 communicates with an external device to receive printing data to be printed on the printing medium or to transmit data corresponding to the printing operation. The controller 610 controls the first and second actuators 622 and 623 to eject the ink from the ink chamber and to adjust or change the area of the restrictor.

Figure 7:
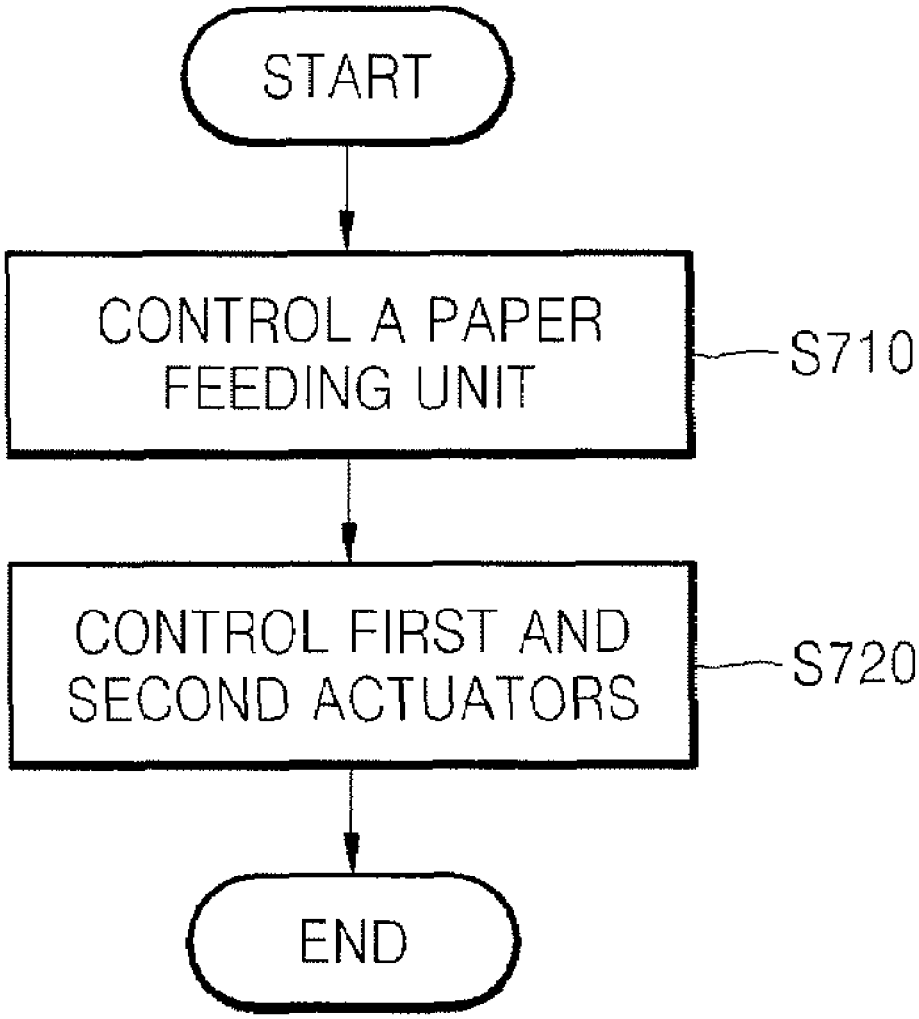
FIG. 7 is a view illustrating a method of an image forming apparatus according to an embodiment of the present general inventive concept.

FIG. 7 is a view illustrating a method of the image forming apparatus according to an embodiment of the present general inventive concept. Referring to FIGS. 3, 6 and 7, the paper feeding unit 630 is controlled to feed the printing medium to be printed and to discharge the printed medium to an outside of the image forming apparatus in operation S710. The printing unit 620 is controlled to perform a printing function in operation S720. The printing function includes controlling the first and second actuators to eject the ink and to control a backflow generated when the ink is ejected by the first actuators. The first and second actuators may be simultaneously operated to change a volume of the ink chamber to eject the ink, and to change a passage area of the restrictor to prevent the backflow from influencing the pressure of the ink chamber and the manifold. However, the present general inventive concept is not limited thereto. The first and second actuators may be operated at a time interval to reduce a backflow of the ink from the ink chamber to the manifold when a pressure or a volume of the ink chamber is changed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A piezoelectric inkjet head comprising:

a flow channel plate that comprises:

an ink inlet through which ink enters;

a plurality of pressure chambers into which ink to be ejected is filled;

a manifold which is a path to receive ink from the ink inlet and to supply the received ink to the pressure chambers;

a plurality of restrictors that connect the manifold to the pressure chambers; and a plurality of nozzles to eject ink from the pressure chambers to an outside thereof, a plurality of first piezoelectric actuators formed on the flow channel plate to correspond to positions of the pressure chambers to provide a driving force to each of the pressure chambers to eject ink to the outside; and a plurality of second piezoelectric actuators formed on the flow channel plate to correspond to positions of the restrictors to change cross-sectional areas of the restrictors.

2. The piezoelectric inkjet head of claim 1, wherein when ink is ejected from the pressure chambers to the outside through the nozzles due to the driving of the first piezoelectric actuators, the cross-sectional areas of the restrictors are also reduced due to the driving of the second piezoelectric actuators to prevent the ink from flowing back from the pressure chambers to the manifold through the restrictors.

3. The piezoelectric inkjet head of claim 2, wherein the second piezoelectric actuators are controlled either in connection with the first piezoelectric actuators or independently from the first piezoelectric actuators.

4. The piezoelectric inkjet head of claim 1, wherein each of the first piezoelectric actuators and each of the second piezoelectric actuators comprises a lower electrode formed on the flow channel plate, a piezoelectric film formed on the lower electrode, and an upper electrode formed on the piezoelectric film.

5. The piezoelectric inkjet head of claim 4, wherein the lower electrodes of the first piezoelectric actuators and the lower electrodes of the second piezoelectric actuators are formed in one conductive metal layer.

6. The piezoelectric inkjet head of claim 1, wherein the flow channel plate comprises a plurality of stacked flow channel plates.

7. The piezoelectric inkjet head of claim 6, wherein the first piezoelectric actuators and the second piezoelectric actuators are formed on an uppermost flow channel plate of the flow channel plates, and portions of the uppermost flow channel plate that cover the pressure chambers and portions of the uppermost flow channel plate that cover the restrictors respectively perform as vibration plates which are deformed due to the driving of the first piezoelectric actuators and the second piezoelectric actuators.

8. The piezoelectric inkjet head of claim 6, wherein each of the flow channel plates is a silicon substrate.

9. A piezoelectric inkjet head comprising:

a manifold to define a first path of ink;

an ink chamber to define a second path of ink;

a restrictor disposed between the manifold and the ink chamber to define a third path between the first path and the second path;

a first actuator to control a volume of the second path of the ink chamber; and a second actuator to control a volume of the third path of the restrictor.

10. The piezoelectric inkjet head of claim 9, further comprising:

a flow channel plate formed with the manifold, the ink chamber, and the restrictor, wherein the first actuator is disposed on a first portion of the flow channel, and the second actuator is disposed on a second portion of the flow channel plate.

11. The piezoelectric inkjet head of claim 10, wherein the first portion and the second portion are spaced-apart from each other in a direction of the second and third paths.

12. The piezoelectric inkjet head of claim 10, wherein the first portion generates a first deformation to the second path of the ink chamber, and the second portion generates a second deformation to the third path of the restrictor.

13. The piezoelectric inkjet head of claim 9, further comprising:

a flow channel plate formed with the manifold, the ink chamber, and the restrictor, wherein the first and second actuators are formed on the flow channel plate to correspond to the ink chamber and the restrictor, respectively.

14. The piezoelectric inkjet head of claim 13, wherein the flow channel plate comprises:

a first plate on which the first and second actuators are formed;

a second plate having the manifold and the restrictor to define the first path and third path with the first plate; and a third plate having a nozzle plate through which the ink is ejected from the ink chamber, and to define the second path with the second plate and the first plate.

15. The piezoelectric inkjet head of claim 9, wherein the flow channel plate comprises:

a first plate; and a second plate formed on the first plate, wherein the manifold, the ink chamber, and the restrictor are formed between the first plate and the second plate to define a first path of ink, a second path of ink, and a third path of ink, respectively.

16. The piezoelectric inkjet head of claim 15, wherein the first and second actuators are formed on one of the first plate and the second plate.

17. The piezoelectric inkjet head of claim 9, wherein the first actuator changes a pressure of the ink chamber, and the second actuator reduces a backflow of the ink from being transmitted from the ink chamber to the manifold when the first actuator changes the pressure of the ink chamber.

18. The piezoelectric inkjet head of claim 9, wherein the first and second actuators simultaneously control volumes of the second path of the ink chamber and the volume of the third path of the restrictor.

19. The piezoelectric inkjet head of claim 9, wherein the second actuator changes a cross-sectional area of the third path of the restrictor.

20. The piezoelectric inkjet head of claim 9, wherein the second actuator comprises a vibration plate to move between a first position and a second position to change the volume of the third path.

21. The piezoelectric inkjet head of claim 9, wherein the second actuator is disposed to face the restrictor through the third path.

22. A piezoelectric inkjet head comprising:

a manifold to define a first path of ink;

an ink chamber to define a second path of ink;

a restrictor disposed between the manifold and the ink chamber to define a third path between the first path and the second path;

a first actuator having a first vibration plate to move between two positions to control the second path of the ink chamber to eject the ink; and a second actuator having a second vibration plate to move between two positions to control the third path of the restrictor to control a backflow of the ink between the ink chamber and the manifold.

23. An image forming apparatus comprising:

a paper feeding unit to feed a printing medium; and a printing unit to print an image on the fed printing medium, and comprising:

a manifold to define a first path of ink, an ink chamber to define a second path of ink, a restrictor disposed between the manifold and the ink chamber to define a third path between the first path and the second path, a first actuator to control a volume of the second path of the ink chamber, and a second actuator to control a volume of the third path of the restrictor.

24. A method of an image forming apparatus, comprising:

providing a print unit having a manifold to define a first path of ink, an ink chamber to define a second path of ink, a restrictor disposed between the manifold and the ink chamber to define a third path between the first path and the second path, a first actuator to control a volume of the second path of the ink chamber, and a second actuator to control a volume of the third path of the restrictor; and controlling the first actuator and the second actuator to eject the ink from the second path to an outside thereof from the ink chamber and to prevent influence of a backflow in the restrictor, respectively.

* * * * *